US005288249A

United States Patent [19]

Fitzgerald

[11] Patent Number: 5,288,249

[45] Date of Patent: Feb. 22, 1994

[54] BASE FOR CARTRIDGE LAMP

[75] Inventor: James J. Fitzgerald, Boonton, N.J.

[73] Assignee: Cooper Industries, Inc., Houston, Tex.

[21] Appl. No.: 946,052

[22] Filed: Sep. 2, 1992

[51] Int. Cl.[5] ..... H01R 17/00

[52] U.S. Cl. ..... 439/612; 439/56; 439/698

[58] Field of Search ..... 439/56, 612, 619, 698, 439/699, 226, 239

[56] References Cited

U.S. PATENT DOCUMENTS 3,360,765 12/1967 Strange et al. ..... 439/612

5,037,309 8/1991 Abe et al. ..... 439/56

5,116,229 5/1992 Savage, Jr. ..... 439/56

5,129,829 7/1992 Arnold et al. ..... 439/56

*Primary Examiner*—Neil Abrams

*Assistant Examiner*—Khiem Nguyen

*Attorney, Agent, or Firm*—Nelson A. Blish; Eddie E. Scott

[57] ABSTRACT

A mounting base for cartridge style electrical lamps includes a base member and a lead housing. The base member positions the mounting base with respect to the source of electrical power and the lead housing positions the cartridge lamp leads for engagement with a source of electrical power.

9 Claims, 2 Drawing Sheets

BASE FOR CARTRIDGE LAMP

BACKGROUND OF THE INVENTION

This invention pertains to cartridge style lamps, more particularly this invention pertains to a mounting base usable with a cartridge style lamp.

Presently, cartridge lamps are held in place by compression spring clips. These compression spring clips either do not hold the lamps securely or crush the lead wires. Cartridge style lamps having two filaments are presently welded into their sockets because there are no satisfactory sockets available.

There is therefore a need in the art to provide a cartridge lamp system whereby cartridge lamps may be easily and quickly mounted with respect to a source of electrical power.

SUMMARY OF THE INVENTION

There is provided by the cartridge lamp mounting system of the present invention an easy and quick way for a cartridge lamp to be mechanically engaged with a source of electrical power.

The cartridge lamp mounting system includes a base member which mechanically and frictionally engages the source of electrical power provided for the cartridge lamp. Formed integrally with or attached to the base member is a lead housing. The lead housing engages and positions the leads coming from the cartridge lamp. The cartridge lamp mounting system of the present invention may be used with either single or multi-filament cartridge style lamps.

DESCRIPTION OF THE DRAWINGS

A better understanding of the mounting base for a cartridge lamp may be had by reference to the drawings, wherein.

DESCRIPTION OF THE EMBODIMENTS

Figure 1:
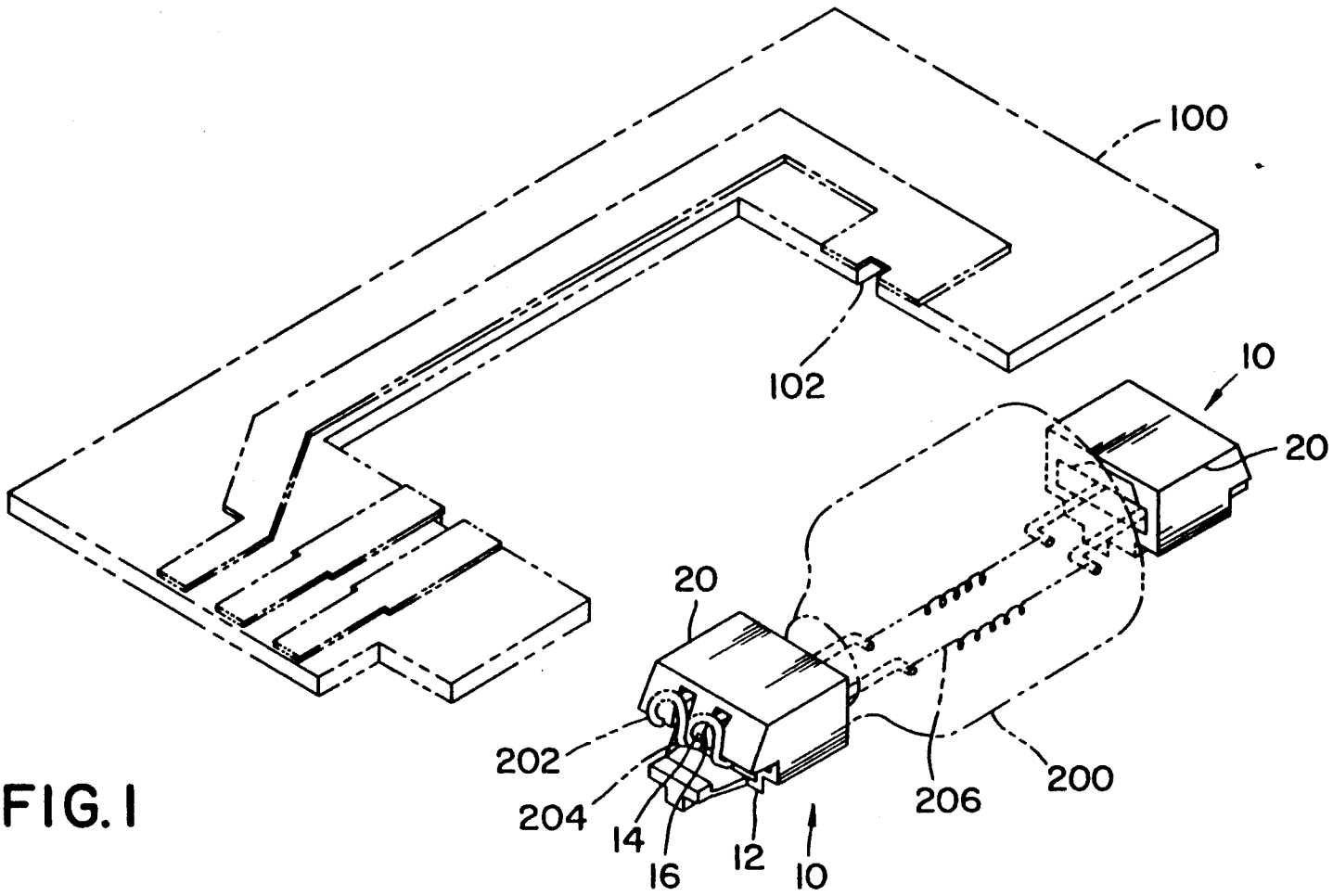
FIG. 1 is a perspective view of the lamp mounting base of the present invention shown in relation to a cartridge lamp and a circuit board power source.
Figure 2:
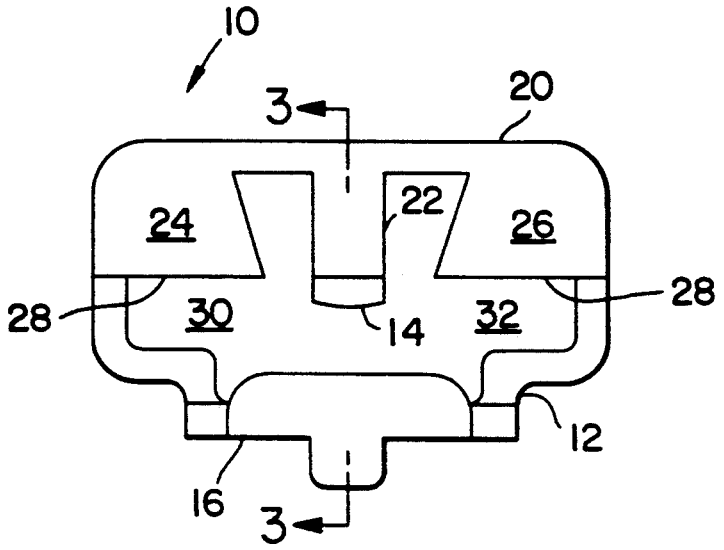
FIG. 2 is an end view of the mounting base.
Figure 3:
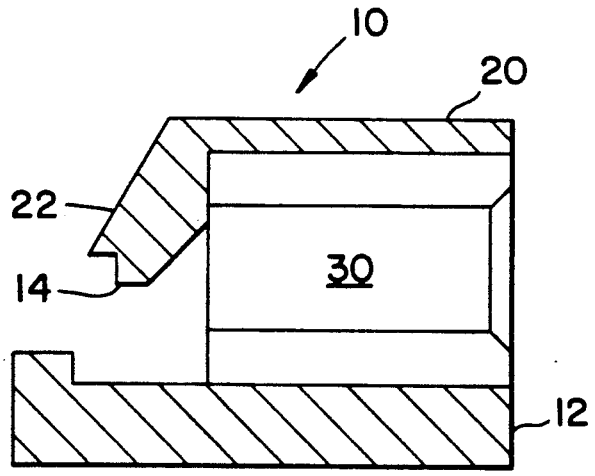
FIG. 3 is a sectional view of the mounting base taken at line 3—3 of FIG. 2.

It may be seen by reference to FIGS. 1, 2, and 3 which depict the cartridge lamp mounting system 10 of the present invention that the mounting base has two portions. The first portion, the base member 12, provides mechanical and frictional engagement with a circuit board or a similar source of electrical power. Base member 12 is shaped for interfitment in notches, holes, openings, key ways 102 or whatever positioning and holding system is used for interconnection with the cartridge lamp 200. Shown in the preferred embodiment is protrusion 14 emanating from the top 22 of base member 12. As may be seen in FIG. 1 protrusion 14 engages opening or slot 102 in circuit board 100.

Formed integrally with or attached to base member 12 is lead housing 20. Contained within lead housing 20 are openings 30 and 32 through which the leads 202 and 204 to the filament(s) 206 in the electrical cartridge lamp 200 are placed. Leads 202 and 204 may be folded back on lead housing 20 to secure lamp mounting system 10 to cartridge lamp 200. This provides a mechanical and frictional engagement.

The mounting base 12 of the present invention may be used on single or multi-filament lamps. For single filament lamps or the common end of a two filament lamp the base is retained on the lamp by center protrusion 22. For two filament lamps the base is retained on the lamp by projections 24 and 26. Center protrusion 22 acts as a separator for the outer lead wires 202 and 204. Surface 28 rests on lead wires 202 and 204 and prevents them from bending.

According to the present invention an electrical cartridge lamp 200 may be quickly and easily positioned with respect to a source of electrical power by use of the mechanical and frictional engagement of base member 12 with a power source such as circuit board. Specifically, a housing 20 for electrical leads is affixed formed integrally with a base member 12. Electrical leads 202 and 204 from a cartridge style lamp 200 are then inserted through the lead housing 20. To retain the mounting base 10 in place on the lamp 200, the leads 202 and 204 are bent so as to mechanically engage the lead housing 20. The cartridge lamp 200 with mounting system 10 affixed to its ends is then placed in position for mechanical and frictional engagement with a source of electrical power.

Other embodiments of the present invention will be understood by those of ordinary skill in the art. Such other embodiments may have a variety of shapes. Such other shapes will not depart from the scope of the present invention. Additionally, a plurality of holes may be provided in lead housing 20 when it is desired to mount multi-filament lamps. Such other embodiments shall be included within the scope of the appended claims.

I claim:

1. A device for mounting a cartridge lamp having one or more electrical leads, said mounting device comprising:

a substantially hollow lead housing having opposite ends with a first opening at one end for receiving a lead or leads from the cartridge lamp and a second opening at the other end;

said housing having a base member with a lower protrusion at the second opening of the lead housing for engaging a surface of a circuit board; and said housing having an upper protrusion in opposing relation to said lower protrusion of said lead housing, whereby an electrical lead may be bent over said upper protrusion for securing the cartridge lamp to the mounting device.

2. A mounting device as claimed in claim 1, wherein said upper protrusion includes a central portion having a notch for engaging the circuit board.

3. A mounting device as claimed in claim 2, wherein said upper protrusion includes two slots, said central portion of said upper protrusion being arranged between said two slots.

4. A mounting device as claimed in claim 1, wherein said housing includes a pair of mounting projections spaced on opposite sides of said upper projection, said mounting projections having substantially flat surfaces whereby leads from said cartridge lamp are retained when said housing is mounted on a circuit board.

5. A light source for mounting on a circuit board, comprising:

a cartridge lamp having at least on electrical lead at each end thereof;

a substantially hollow lead housing arranged over each of said leads from the cartridge lamp;

each of said lead housings including:

a first opening at a first end for receiving one of the leads from one end of said cartridge lamp;

a second opening at a second end of said housing opposite said first end of said housing for exposing said one lead for connection with said circuit board;

a lower protrusion from a lower portion of the second end of the lead housing for engaging a surface of the circuit board; and an upper protrusion overhanging said second opening of said lead housing, said at least one electrical lead being bendable over said upper protrusion for securing the cartridge lamp to the mounting device.

6. A light source as claimed in claim 5, wherein said upper protrusion includes a central portion having a notch for engaging the circuit board.

7. A light source as claimed in claim 6, wherein said upper protrusion includes two slots, said central portion of said upper protrusion being arranged between said two slots.

8. A method of mounting a cartridge lamp in a socket on a circuit board, said cartridge lamp having an electrical lead extending from each of two opposite ends of the lamp, said method comprising the steps of:

inserting each of said leads through respective lead housings, each of said lead housings being substantially hollow and having an opening at each end, each of said lead housings having an upper protrusion overhanging one of said openings, said upper protrusion including a central portion for engaging the circuit board;

securing said respective lead housings to each end of said cartridge lamp by bending respective leads over said upper protrusions from the respective lead housings;

aligning the central portions of said secured lead housings with respective slots at each end of the socket in said circuit board;

sliding the upper portion of said respective lead housings into said socket.

9. A method as claimed in claim 8, wherein during said sliding step, a lower protrusion from below said one opening abuts a surface of said circuit board.

* * * * *